US009884695B2

(12) United States Patent
Pattison et al.

(10) Patent No.: US 9,884,695 B2
(45) Date of Patent: Feb. 6, 2018

(54) COMPARTMENT CONFIGURED FOR PRESENTATION OF STORED ARTICLES

(71) Applicant: Aesynt Incorporated, Cranberry, PA (US)

(72) Inventors: William B. Pattison, Mars, PA (US); Jeffrey Thompson, Allison Park, PA (US)

(73) Assignee: Aesynt Incorporated, Cranberry, PA (US)

( * ) Notice: Subject to any disclaimer, the term of this patent is extended or adjusted under 35 U.S.C. 154(b) by 940 days.

(21) Appl. No.: 13/852,729

(22) Filed: Mar. 28, 2013

(65) Prior Publication Data

US 2014/0290189 A1 Oct. 2, 2014

(51) Int. Cl.

| | |
|---|---|
| ***B65D 25/04*** | (2006.01) |
| ***B65B 69/00*** | (2006.01) |
| ***G07F 17/00*** | (2006.01) |
| ***G07F 11/62*** | (2006.01) |

(52) U.S. Cl.

CPC ..... *B65B 69/00* (2013.01); *G07F 11/62* (2013.01); *G07F 17/0092* (2013.01)

(58) Field of Classification Search

CPC ..... G07F 17/0092; G07F 11/62; B65D 43/16; B65D 51/246; B65D 25/04

USPC ..... 220/832, 524, 212

See application file for complete search history.

(56) References Cited

U.S. PATENT DOCUMENTS

| | | | | |
|---|---|---|---|---|
| 4,658,422 | A * | 4/1987 | Sparks | H04Q 1/028 220/3.8 |
| 4,717,042 | A | 1/1988 | McLaughlin | |
| 4,785,969 | A | 11/1988 | McLaughlin | |
| 4,847,764 | A | 7/1989 | Halvorson | |
| 4,887,747 | A * | 12/1989 | Ostrowsky | B65D 47/0861 16/342 |
| 4,930,637 | A * | 6/1990 | DeRoseau | A45C 11/20 206/216 |
| 5,014,875 | A | 5/1991 | McLaughlin et al. | |
| 5,190,185 | A | 3/1993 | Blechl | |
| 5,314,243 | A | 5/1994 | McDonald et al. | |
| 5,346,297 | A | 9/1994 | Colson, Jr. et al. | |
| 5,377,864 | A | 1/1995 | Blechl et al. | |
| 5,405,048 | A | 4/1995 | Rogers et al. | |
| 5,431,299 | A | 7/1995 | Brewer et al. | |
| 5,460,294 | A | 10/1995 | Williams | |
| 5,468,110 | A | 11/1995 | McDonald et al. | |
| 5,480,062 | A | 1/1996 | Rogers et al. | |

(Continued)

*Primary Examiner* — Stephen Castellano

(74) *Attorney, Agent, or Firm* — Alston & Bird LLP

(57) ABSTRACT

Storage units are described for storing articles. The storage units include a number of compartments, and the compartments include a receptacle, a lid, and a holding member. The receptacle receives the article via an opening, and the lid may move into and out of engagement with the opening so as to define an open position and a closed position. The holding member may be disposed on the lid and may be configured to releasably secure the article to the lid. Thus, in the closed position, the holding member and an article secured to the lid via the holding member may be received within the receptacle, whereas in the open position the article may be at least partially removed from the receptacle. Thus, when the lid is opened, the article is automatically presented to the user for dispensing the article from the compartment.

8 Claims, 7 Drawing Sheets

(56) References Cited

U.S. PATENT DOCUMENTS 5,520,450 A 5/1996 Colson, Jr. et al.
5,564,803 A 10/1996 McDonald et al.
5,586,676 A * 12/1996 Lynd ..... B65D 51/246 215/228
5,593,267 A 1/1997 McDonald et al.
5,661,978 A 9/1997 Holmes et al.
D384,578 S 10/1997 Wangu et al.
5,713,485 A 2/1998 Liff et al.
5,716,114 A 2/1998 Holmes et al.
5,745,366 A 4/1998 Higham et al.
5,761,877 A 6/1998 Quandt
5,797,515 A 8/1998 Liff et al.
5,805,456 A 9/1998 Higham et al.
5,842,976 A 12/1998 Williamson
5,878,885 A 3/1999 Wangu et al.
5,880,443 A 3/1999 McDonald et al.
5,883,806 A 3/1999 Meador et al.
5,893,697 A 4/1999 Zini et al.
5,905,653 A 5/1999 Higham et al.
5,912,818 A 6/1999 McGrady et al.
5,927,540 A 7/1999 Godlewski
5,940,306 A 8/1999 Gardner et al.
5,971,593 A 10/1999 McGrady
6,003,006 A 12/1999 Colella et al.
6,011,999 A * 1/2000 Holmes ..... E05B 65/46 312/215
6,021,392 A 2/2000 Lester et al.
6,039,467 A 3/2000 Holmes
6,065,819 A 5/2000 Holmes et al.
6,068,156 A 5/2000 Liff et al.
6,109,774 A 8/2000 Holmes et al.
6,112,502 A 9/2000 Frederick et al.
6,116,461 A 9/2000 Broadfield et al.
6,151,536 A 11/2000 Arnold et al.
6,170,230 B1 1/2001 Chudy et al.
6,176,392 B1 1/2001 William et al.
6,189,727 B1 2/2001 Shoenfeld
6,223,934 B1 5/2001 Shoenfeld
6,256,967 B1 7/2001 Hebron et al.
6,283,322 B1 9/2001 Liff et al.
6,289,656 B1 9/2001 Wangu et al.
6,338,007 B1 1/2002 Broadfield et al.
6,339,732 B1 1/2002 Phoon et al.
6,361,263 B1 3/2002 Dewey et al.
6,370,841 B1 4/2002 Chudy et al.
6,449,927 B2 9/2002 Hebron et al.
6,471,089 B2 10/2002 Liff et al.
6,497,342 B2 12/2002 Zhang et al.
6,499,270 B2 12/2002 Peroni et al.
6,532,399 B2 3/2003 Mase
6,564,121 B1 5/2003 Wallace et al.
6,581,798 B2 6/2003 Liff et al.
6,609,047 B1 8/2003 Lipps
6,611,733 B1 8/2003 De La Huerga
6,625,952 B1 9/2003 Chudy et al.
6,640,159 B2 10/2003 Holmes et al.
6,650,964 B2 11/2003 Spano, Jr. et al.
6,671,579 B2 12/2003 Spano, Jr. et al.
6,681,149 B2 1/2004 William et al.
6,742,671 B2 6/2004 Hebron et al.
6,755,931 B2 6/2004 Vollm et al.
6,760,643 B2 7/2004 Lipps
6,776,304 B2 8/2004 Liff et al.
6,785,589 B2 8/2004 Eggenberger et al.
6,790,198 B1 9/2004 White et al.
6,814,254 B2 11/2004 Liff et al.
6,814,255 B2 11/2004 Liff et al.
6,847,861 B2 1/2005 Lunak et al.
6,874,684 B1 4/2005 Denenberg et al.
6,892,780 B2 5/2005 Vollm et al.
6,895,304 B2 5/2005 Spano, Jr. et al.
6,975,922 B2 12/2005 Duncan et al.
6,985,797 B2 1/2006 Spano, Jr. et al.
6,996,455 B2 2/2006 Eggenberger et al.
7,010,389 B2 3/2006 Lunak et al.
7,014,063 B2 3/2006 Shows et al.
7,016,766 B2 3/2006 William et al.
7,040,504 B2 5/2006 Broadfield et al.
7,048,133 B2 * 5/2006 Pangerc ..... B25H 3/023 220/4.22
7,052,097 B2 5/2006 Meek, Jr. et al.
7,072,737 B2 7/2006 Lunak et al.
7,072,855 B1 7/2006 Godlewski et al.
7,077,286 B2 7/2006 Shows et al.
7,085,621 B2 8/2006 Spano, Jr. et al.
7,092,796 B2 8/2006 Vanderveen
7,093,755 B2 8/2006 Jordan et al.
7,100,792 B2 9/2006 Hunter et al.
7,103,419 B2 9/2006 Engleson et al.
7,111,780 B2 9/2006 Broussard et al.
7,139,639 B2 11/2006 Broussard et al.
7,150,724 B2 12/2006 Morris et al.
7,171,277 B2 1/2007 Engleson et al.
7,218,231 B2 5/2007 Higham
7,228,198 B2 6/2007 Vollm et al.
7,249,688 B2 7/2007 Hunter et al.
7,348,884 B2 3/2008 Higham
7,417,729 B2 8/2008 Greenwald
7,419,133 B2 9/2008 Clarke et al.
7,426,425 B2 9/2008 Meek, Jr. et al.
7,554,449 B2 6/2009 Higham
7,571,024 B2 8/2009 Duncan et al.
7,588,167 B2 9/2009 Hunter et al.
7,971,747 B2 * 7/2011 Blomdahl ..... B65D 51/246 220/212
2008/0015956 A1 * 1/2008 Regard ..... A47F 9/042 705/28
2013/0001184 A1 * 1/2013 Groubert ..... B65D 47/0828 215/235

* cited by examiner

COMPARTMENT CONFIGURED FOR PRESENTATION OF STORED ARTICLES

BACKGROUND

Small, loose articles, such as unit dose medications, are often stored in compartments of a storage unit, such as a cabinet or cart. Depending on the size of the compartment, the configuration of the article, and the angle of the user with respect to the stored article, it may be difficult to remove the desired article from the compartment in which it is stored. Conventional compartments are often sized large enough so that a user can reach into the compartment to grasp the desired article.

In certain applications, such as in the context of a health care provider (e.g., a hospital, pharmacy, physicians' office, nursing home, dentist's office, or the like), it is often critical that the correct article is dispensed from the storage unit and that the dispensing process itself is not burdensome or time-consuming.

Accordingly, there is a need in the art for devices and methods of facilitating the removal of such articles from their respective compartments in a manner that is both accurate and efficient.

BRIEF SUMMARY OF THE INVENTION

Embodiments of the present invention address, among other things, the above need by providing a compartment that is configured to facilitate the dispensing of small articles from within the compartment by at least partially removing the article from the receptacle of the compartment and presenting the article to the user. In this way, the user can more easily see, grab, and remove the article from its compartment.

Accordingly, a compartment for storing an article is provided, where the compartment comprises a receptacle, a lid, and a holding member. The receptacle may be configured to receive an article and may define an opening via which the article is received. The lid may be configured to move into and out of engagement with the opening of the receptacle so as to define an open position in which the lid is out of engagement with the opening of the receptacle and a closed position in which the lid is in engagement with the opening of the receptacle. The holding member may be disposed on the lid, and the holding member may be configured to releasably secure the article to the lid. In the closed position, the holding member and an article secured to the lid via the holding member may be received within the receptacle, whereas in the open position, the article secured to the lid via the holding member may be at least partially removed from the receptacle so as to be presented to a user for dispensing from the compartment.

In some embodiments, the holding member may comprise a first arm and a second arm, and the first and second arms may be configured to receive at least a portion of the article therebetween. The first and second arms of the holding member may, for example, define a C-shape. Moreover, the first and second arms of the holding member may be biased toward each other. In some cases, the holding member may be integral to the lid. The lid may be connected to the receptacle via a hinge.

The compartment may be oriented such that the lid and the holding member support a side of the article in the open position. In some embodiments, a sensor may be disposed on at least one of the lid, the receptacle, or the holding member, and the sensor may be configured to detect removal of the article secured to the lid via the holding member.

In some cases, the lid may be biased toward the closed position. The lid may be configured to provide dual-direction biasing. In some embodiments, the holding member may comprise an array of holding members.

In other embodiments, a storage unit for dispensing medication comprising a plurality of compartments may be provided. At least one of the compartments may comprise a receptacle, a lid, and a holding member. The receptacle may be configured to receive an article and may define an opening via which the article is received. The lid may be configured to move into and out of engagement with the opening of the receptacle so as to define an open position in which the lid is out of engagement with the opening of the receptacle and a closed position in which the lid is in engagement with the opening of the receptacle. The holding member may be disposed on the lid, and the holding member may be configured to releasably secure the article to the lid. In the closed position, the holding member and an article secured to the lid via the holding member may be received within the receptacle, whereas in the open position, the article secured to the lid via the holding member may be at least partially removed from the receptacle so as to be presented to a user for dispensing from the compartment.

In some cases, the holding member may comprise a first arm and a second arm, and the first and second arms may be configured to receive at least a portion of the article therebetween. The first and second arms of the holding member may be biased toward each other. Additionally or alternatively, at least some of the compartments may be oriented with respect to the storage unit such that the respective lid and holding member support a side of the article in the open position.

In still other embodiments, a method of dispensing medication from a storage unit is provided comprising storing an article within a compartment of the storage unit and presenting the article to a user for dispensing from the compartment. The compartment may comprise a receptacle, a lid, and a holding member. The receptacle may be configured to receive the article and may define an opening via which the article is received. The lid may be configured to move into and out of engagement with the opening of the receptacle so as to define an open position in which the lid is out of engagement with the opening of the receptacle and a closed position in which the lid is in engagement with the opening of the receptacle. The holding member may be disposed on the lid. The article may be releasably secured to the lid via the holding member.

Presentation of the article to a user for dispensing from the compartment may occur upon movement of the lid to the open position. Presenting the article to the user may comprise partially removing the article from the receptacle. In the closed position, the holding member and the article may be received within the receptacle. Moreover, storing the article within the compartment may comprise receiving the article between a first arm and a second arm of the holding member.

In some cases, presenting the article to the user may comprise supporting a side of the article. Additionally or alternatively, removal of the article secured to the lid via the holding member may be detected.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
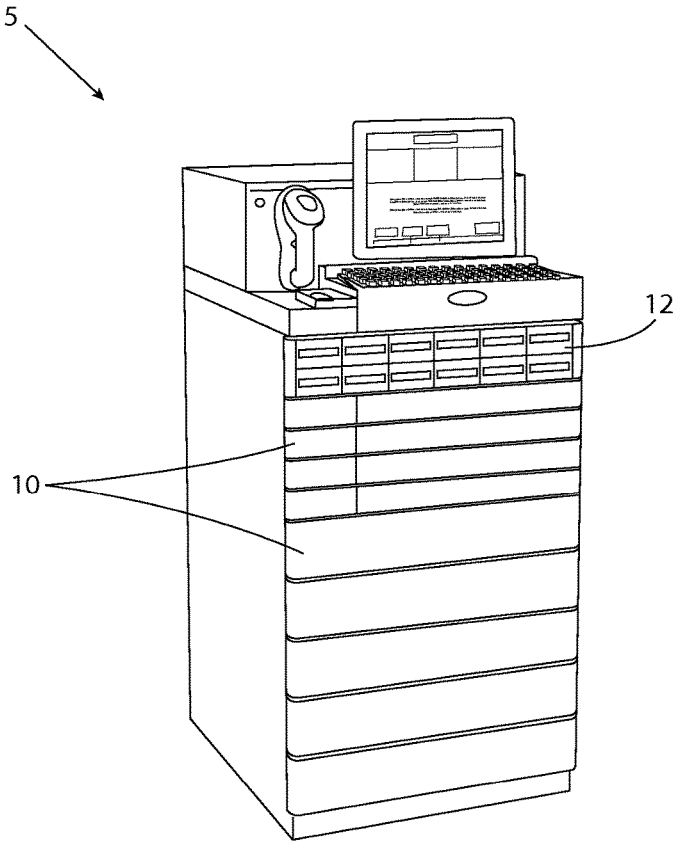
FIG. 1 illustrates a storage unit including a number of drawers in accordance with one example embodiment.

Embodiments of the present inventions now will be described more fully hereinafter with reference to the accompanying drawings, in which some, but not all embodiments of the inventions are shown. Indeed, embodiments of these inventions may be embodied in many different forms and should not be construed as limited to the embodiments set forth herein; rather, these embodiments are provided so that this disclosure will satisfy applicable legal requirements. Like reference numerals refer to like elements throughout.

Although the description that follows includes examples in which embodiments of the invention are used in the context of compartments of medication storage units (such as unit dose compartments of a cabinet at a nurse's station in a hospital) for ease of explanation, it is understood that embodiments of the invention may benefit and improve various types of storage units storing various types of articles, related and unrelated to the health care industry. For example, embodiments of the invention may be used for storage units for storing construction tools, sewing equipment, candy, or any other articles that are relatively small, are discrete, and can be presented to a user for removal from the compartment as described below.

Figure 2:
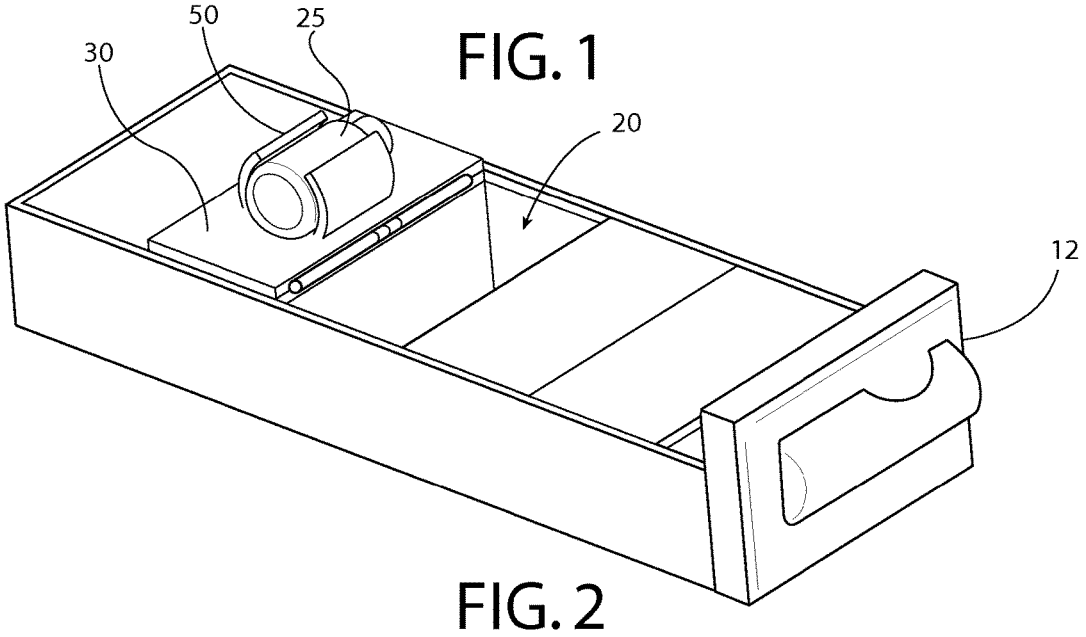
FIG. 2 illustrates a drawer of the storage unit of FIG. 1 including compartments in accordance with one example embodiment of the present invention.

As noted above, small, loose articles, such as vials, blister packs, one-time use syringes, and the like, are often placed in compartments of storage units. Turning to FIGS. 1 and 2, for example, a storage unit 5 may be configured to store a number of different types and quantities of medication. The storage unit 5 may include one or more drawers 10. The term "drawer" as used herein may refer to a structural division of space used for storing items. For example, the drawer 10 may be slideably received within the storage unit 5, as depicted, or the drawer may be fixed within the storage unit (such as, e.g., a shelf or the like).

Different types of storage units 5 may include different sizes and styles of drawers 10, depending on the types of medications to be stored in the drawers, the quantities required (which may be dictated by the size of the facility), and user preferences. For example, as shown in FIG. 1, some drawers 10 may be sized to hold unit dose medication (e.g., medication that represents a single dose to be administered to the patient), referenced herein as a unit dose dispensing drawer. In this regard, a unit dose dispensing drawer 12 may be sized smaller and/or shallower than other drawers, such that a unit dose dispensing drawer (shown in FIG. 2) may include four, six, eight, or more compartments 20, and the storage unit 5 may include four, five, six, or more unit dose dispensing drawers in each row. In the depicted embodiment of FIGS. 1 and 2, two rows of unit dose dispensing drawers 12 are provided, each row includes six drawers, and each drawer includes six compartments 20.

Referring to FIG. 2, each compartment 20 may be configured to store at least one article 25, such as a container or dispenser holding a single dose of a particular medication. Thus, depending on the size, form (e.g., liquid, pill, capsule, etc.), packaging (e.g., cartridge strip, bottle, etc.), and/or special requirements for the medication (e.g., restricted access, such as a narcotic; medication requiring refrigeration; etc.), the particular configuration (e.g., size and shape) of the compartment 20 may be different from one drawer 12 to the next or within the same drawer. Furthermore, as shown, some compartments 20 may include lids 30 to keep the contents of the compartment in place and/or to provide a level of security for certain types of articles 25, as described in greater detail below. Some lids 30 may be clear, allowing a user to view the contents of the compartment 20 with the lid closed, while others may be opaque, obscuring the view of the contents. In still other cases, the lids 30 may be locked until access by an authorized user to the contents of the locked compartment 20 is granted, at which time the lid may be unlocked and/or opened to allow retrieval of the article 25 stored therein. The compartment 20 may be sized to have dimensions that are close to the overall dimensions of the article 25 (or articles) to be stored in the compartment, rather than being oversized to accommodate a user's hand or fingers for manually removing the article. In this way, there may be minimal wasted space in compartments 20 configured according to embodiments of the invention.

As noted above, the dispensing of small articles 25 from compartments such as the compartments 20 of the unit dose dispensing drawers 12 may be difficult for a user. Depending on the user's height and the position of the unit dose dispensing drawer 12 within the storage unit 5, the user may not be able to see the article stored within the drawer to verify that the correct article is being dispensed until after the article has been removed from the drawer. Moreover, depending on the actual size and shape of the article 25, the user may have difficulty grasping and removing the article from the compartment 20. When multiple articles 25 are stored in a single compartment 20, the user may inadvertently grasp and/or dispense more than one article, requiring the user to examine the articles withdrawn from the compartment, select a particular article to be dispensed, and return the rest of the articles back to the compartment. Such unnecessary handling may delay the administration of the medication to the patient, result in articles being accidently dropped on the ground (which, depending on the packaging of the article, may destroy and/or otherwise waste medication, and/or may cause the user to be frustrated).

Figure 3:
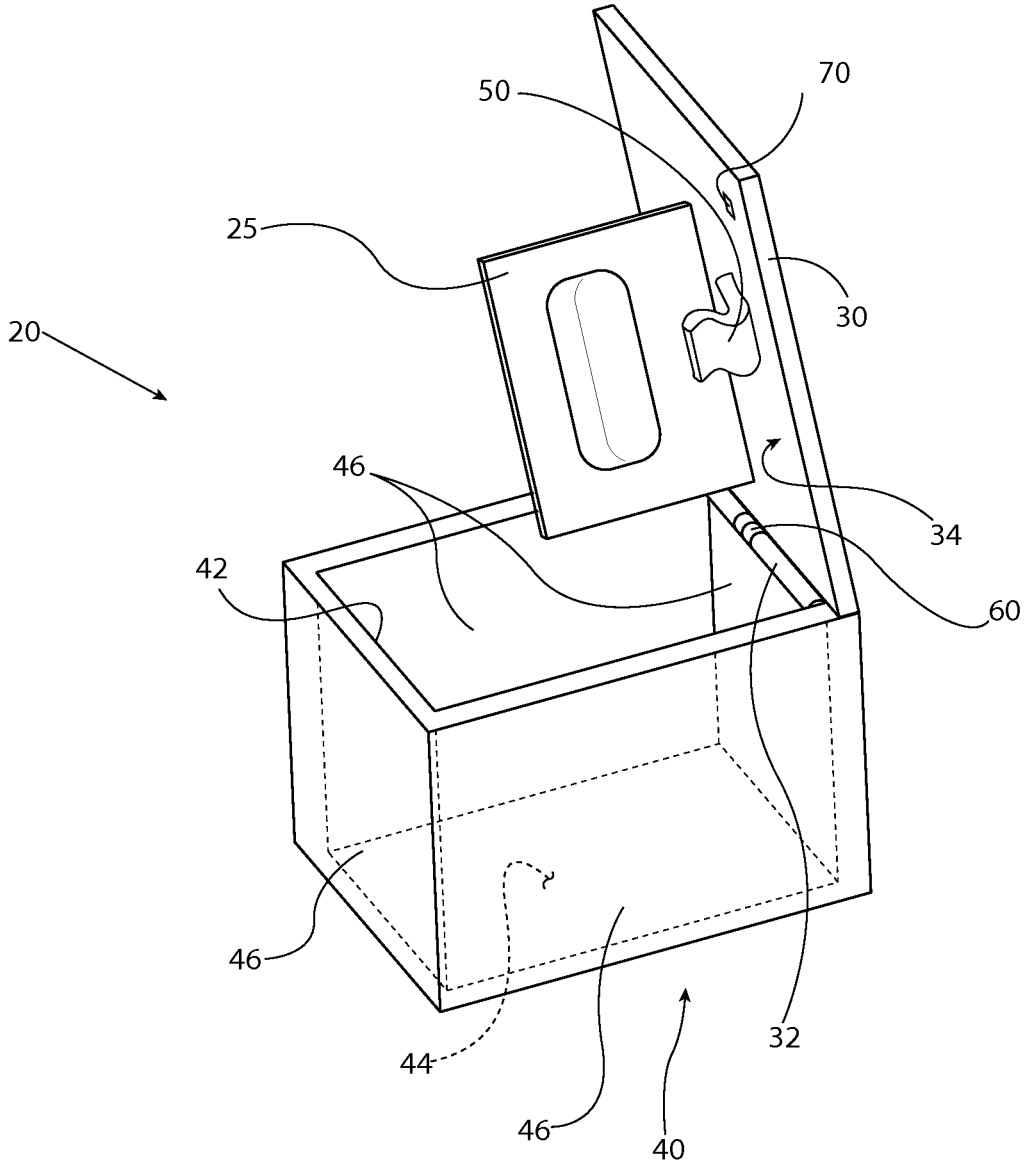
FIG. 3 illustrates a compartment having a receptacle and a lid in the open position accordance with one example embodiment of the present invention.
Figure 4:
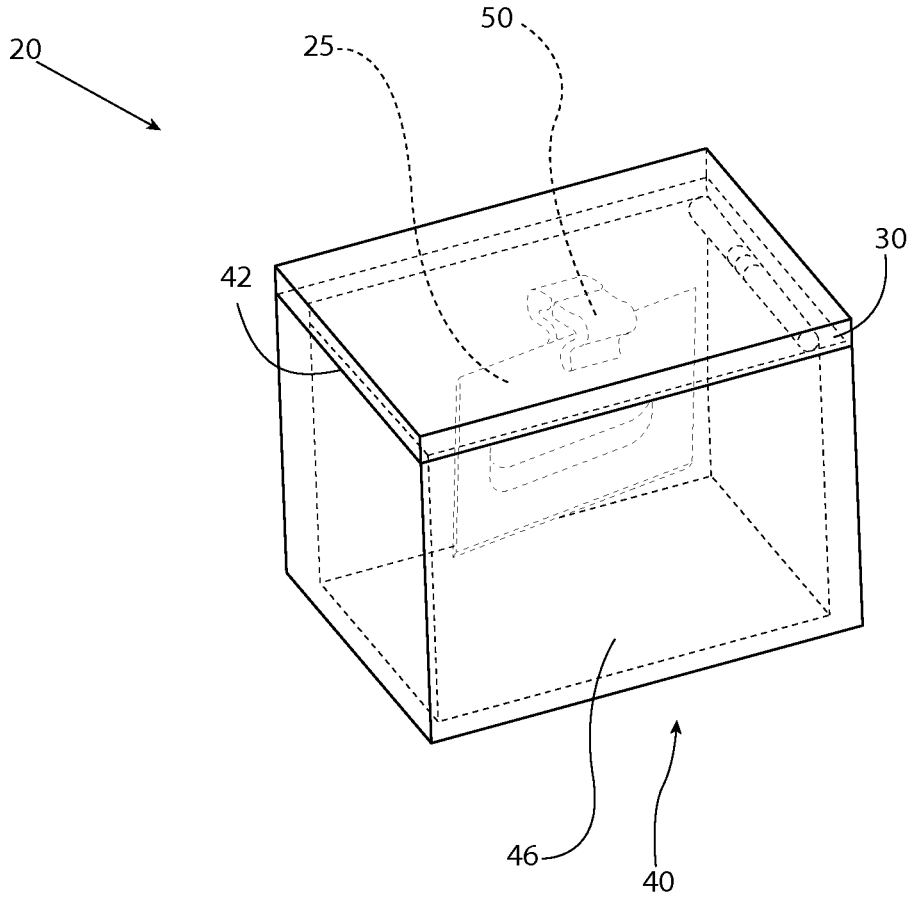
FIG. 4 illustrates a compartment having a receptacle and a lid in the closed position in accordance with one example embodiment of the present invention.

A storage unit is thus provided according to embodiments of the invention that includes a number of compartments 20, one of which is shown in FIGS. 3 and 4. It is understood that although a particular configuration of an article 25 is shown in FIGS. 3 and 4, many other types, sizes, and quantities of articles may benefit from embodiments of the invention, as described below, for example, with reference to FIGS. 5A-5I. The compartments 20 may be configured for storing at least one article 25 and may include a receptacle 40, a lid 30, and a holding member 50. The receptacle 40 may be configured to receive the article 25 and may define an opening 42 via which the article is received. The lid 30 may be configured to move into and out of engagement with the opening 42 of the receptacle 40 so as to define an open position (shown in FIG. 3) in which the lid is out of engagement with the opening of the receptacle and a closed position (shown in FIG. 4) in which the lid is in engagement with the opening of the receptacle. For example, the lid 30 may be connected to the receptacle 40 via a hinge 32, as shown.

The holding member 50, in turn, may be disposed on the lid 30. The holding member 50 may be configured to releasably secure the article 25 to the lid 30. Thus, in the closed position (shown in FIG. 4), the holding member 50 and an article 25 that is secured to the lid 30 via the holding member may be received within the receptacle 40, as shown. In the open position (shown in FIG. 3), the article 25 secured to the lid 30 via the holding member 50 may be at least partially removed from the receptacle 40. Thus, when the lid 30 is opened, the article 25 is automatically presented to the user for dispensing the article from the compartment 20. In other words, because the article 25 is being held by the holding member 50, the article moves with the lid 30, and opening the compartment 20 removes the article at least part of the way out of the receptacle 40 so that the user need not reach into the receptacle to grasp the article, but may simply pluck the article from the holding member to dispense it. Presentation of the article 25 to the user in this manner thus serves to make the article more visible to the user (e.g., it is no longer inside the receptacle 40 and can be easily identified), as well as making the article separately and more easily graspable by the user, as it is separately held out to the user for dispensing, rather than haphazardly sitting within the receptacle, possibly with other similar articles.

The holding member 50 may, for example, be a separate structure that is attached (e.g., adhered, fastened, welded, or otherwise connected) to the inner surface 34 of the lid 30. In some embodiments, however, the holding member 50 may be integral to the lid 30. The holding member 50 may be made of any suitable material, such as metal or plastic material. For example, the holding member 50 may be integrally molded with the lid 30 (e.g., in cases in which the lid is made of a molded plastic material).

The holding member 50 may have various configurations depending on the type of article 25 that is to be stored within the respective compartment 20. For example, articles 25 that may be stored within the compartment include unit dose packaging (FIG. 5A), unit dose blister packaging (FIG. 5B), vials (FIG. 5C), ampoules (FIG. 5D), single dose syringes (FIG. 5E), packaged single dose syringes (FIG. 5F), tubes (FIG. 5G), packets (FIG. 5H), tubs (FIG. 5I), and so on. The holding member 50 may be configured (e.g., sized and shaped) so as to securely hold the particular article 25 to the lid 30 in both the open and closed positions, as well as while the lid is being moved between the open and closed positions.

Figure 6A:
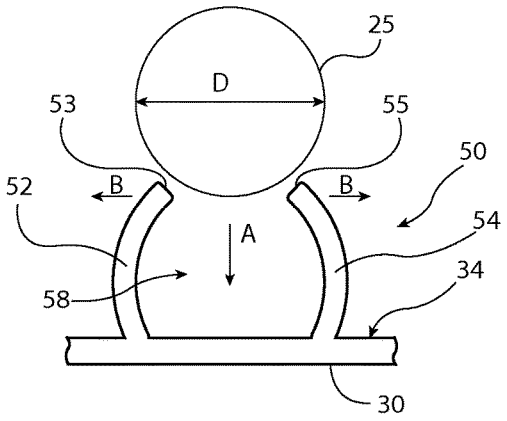
FIGS. 6A-6D illustrate examples of configurations of holding members for storing different configurations of articles in accordance with example embodiments of the present invention.
Figure 6B:
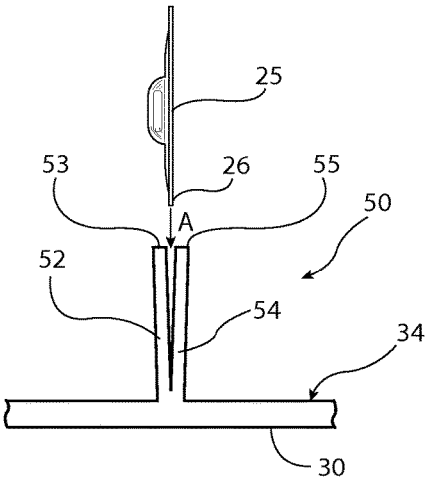
Figure 6C:
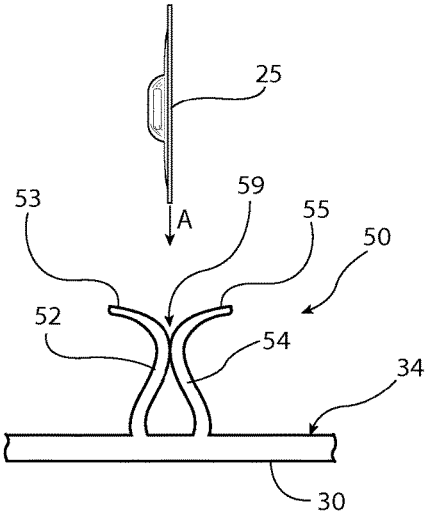

Accordingly, with reference to FIGS. 6A-6C, the holding member 50 may include a first arm 52 and a second arm 54. The first and second arms 52, 54 may be configured in various ways to receive at least a portion of the article 25 therebetween. For example, in some embodiments, the first and second arms 52, 54 of the holding member 50 may be biased toward each other. In some cases, such as when articles 25 having a circular dimension are to be stored in the compartment (e.g., vials, ampoules, syringes, etc.), the first and second arms 52, 54 of the holding member 50 may define a C-shape, as depicted in FIG. 6A. In this regard, each arm 52, 54 may extend from the inner surface 34 of the lid 30 and may include a free end 53, 55. The user may secure the article 25 to the lid 30 by pushing the article past the free ends 53, 55 and into a receiving space 58 defined between the two arms, as indicated by the arrow A in FIG. 6A.

In embodiments in which the first and second arms 52, 54 are biased toward each other, the free ends 53, 55 may have a tendency to move inward, towards the receiving space 58 and the received article 25, based on the bias of the arms. Thus, by pushing the article 25 in the direction A, the free ends 53, 55 and the respective arms 52, 54 may be pushed outward (e.g., momentarily overcoming the bias), in the direction B as indicated, so as to allow the article to be received within the receiving space 58. Once the widest dimension D of the article 25 has passed through the free ends 53, 55, the free ends and the respective arms 52, 54 may move back towards the article 25 due to the bias force to hold the article in place.

In other embodiments, as shown in FIG. 6B, the first and second arms 52, 54 may be configured more linearly (as compared to the C-shaped configuration depicted in FIG. 6A), and may, for example, comprise substantially flat strips of material that are configured to receive a flat portion of the article 25 therebetween. As another example, the first and second arms 52, 54 may include other configurations of components that define planar engaging surfaces for securing the article, such as in a manner similar to the curved wires of a paper clip. For example, articles 25 such as unit dose packages (FIG. 5A) and unit dose blister packages (FIG. 5B) may include relatively thin portions 26 of the packaging (e.g., where portions of the packaging are sealed to each other on a periphery of the package), and these relatively thin portions may be received between the free ends 53, 55 and may be held between the first and second arms 52, 54, which may (as noted above) be biased toward each other.

Figure 5A:
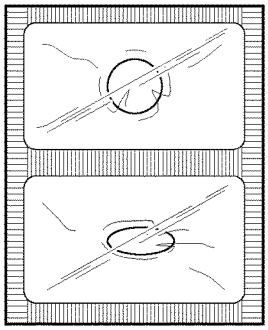
FIGS. 5A-5I illustrate examples of articles that may be stored in compartments configured in accordance with one example embodiment of the present invention.
Figure 5B:
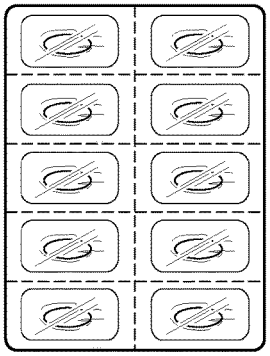
Figure 5C:
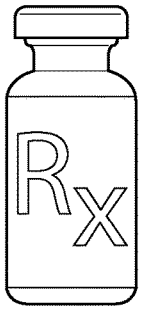
Figure 5D:
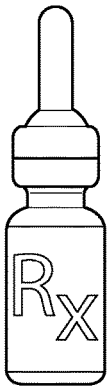
Figure 5E:
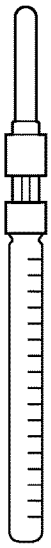
Figure 5F:
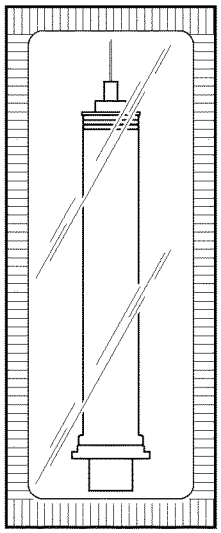
Figure 5G:
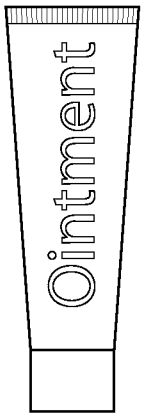
Figure 5H:
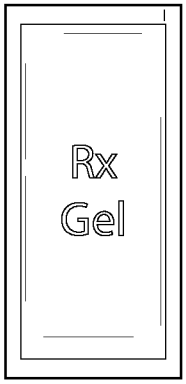

In another example, in the embodiment shown in FIG. 6C, each of the first and second arms 52, 54 may be configured to define an S-shape, and the respective free ends 53, 55 may include an engaging portion 59 that is configured to contact and frictionally engage a corresponding surface of the article 25 (e.g., the unit dose package or unit dose blister package shown in FIGS. 5A and 5B). Again, the first and second arms 52, 54 may be biased toward each other, such that the arms are pushed outward, away from each other in the direction B, as the article 25 is moved in the direction A, and the engaging portions 59 exert a force on corresponding surfaces of the article to hold it in place between the two arms.

Figure 5I:
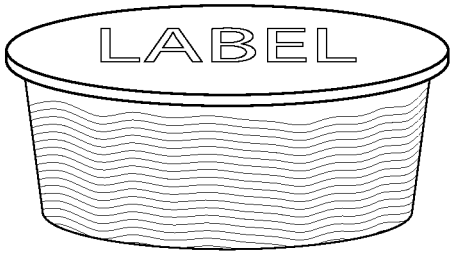
Figure 6D:
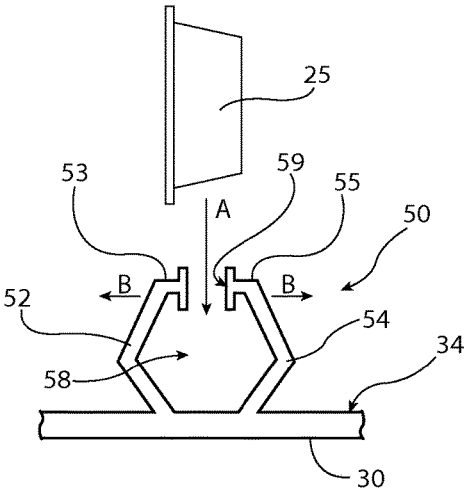

In still other embodiments, as shown in FIG. 6D, the first and second arms 52, 54 may be configured to receive bulkier configurations of packaging, such as tubs (FIG. 5I). In this regard, each of the first and second arms 52, 54 may have a V-shape, and the respective free ends 53, 55 may include an engaging portion 59 that is configured to contact and frictionally engage a corresponding surface of the article 25 (e.g., the tub shown in FIG. 5I). Again, the first and second arms 52, 54 may be biased toward each other, such that the arms are pushed outward, away from each other in the direction B, as the article 25 is moved in the direction A, and the engaging portions 59 exert a force on corresponding surfaces of the article to hold it in place between the two arms, at the same time allowing for odd- or non-uniformly-shaped packaging of the articles to be accommodated by the receiving space 58 due to the V-shape of each arm.

Although several configurations of the holding member 50 are described above and depicted in FIGS. 6A-6D, various other configurations may be provided according to embodiments of the invention. In this regard, the holding member 50 may be configured to receive and secure one or more of the articles 25 (and/or packaging configurations) shown in FIGS. 5A-5I. In other embodiments, however, packaging for the articles 25 may be specially designed to optimize or facilitate securement by the holding member 50.

Turning again to FIGS. 1 and 2, in some cases the compartments 20 may be arranged within a drawer 12 of the storage unit 5 such that the opening 42 of the receptacle 40 (shown in FIG. 3) is facing up, and the receptacle defines a wall 44 and four sidewalls 46 (also shown in FIG. 3), where the wall 44 forms a bottom wall of the receptacle. In such configurations, the article 25 secured to the lid 30 via the holding member 50 may be lowered into the receptacle 40 upon closure of the lid and lifted up and out of the receptacle for presentation to the user upon opening of the lid, as illustrated in FIG. 2, for example. According to these configurations, the lid 30, in the open position, may rest on an adjacent compartment, such as the compartment in front of the compartment being accessed, and may, as a result, require that the lid 30 of this adjacent compartment be in the closed position so as not to interfere with the opening and closure of the compartment being accessed. In this regard, at least some of the compartments 20 may be oriented with respect to the storage unit such that the respective lid 30 and holding member 50 support a side of the article in the open position (e.g., minimizing the risk of dislodging the article when the lid is opened and the article is presented to the user).

In other embodiments, the compartments may be oriented such that the wall 44 forms a rear wall of the receptacle 40, as shown in FIG. 3. In the orientation shown in FIG. 3, the respective lid 30 and holding member 50 may again support a side of the article 25 in the open position, in that the lid and/or receptacle may comprise a stop feature that maintains the lid at a 180° angle with respect to the adjacent sidewall 46 (e.g., the sidewall connected to the lid via the hinge 32) in the open position. In this way, the lid 30 may again help prevent the article or articles 25 being presented from falling to the floor when the lid is in the open position. For example, an array of compartments 20 may be built into or attached on a wall (e.g., providing a storage unit having a depth equivalent to that of a single compartment and extending a width and height equivalent to that of the number of compartments in the array). Whereas such a configuration of conventional compartments may create a risk of the article 25 tipping and/or rolling out of the receptacle 40 and onto the floor when the lid 30 is opened by a user, embodiments of the invention may secure the article in place until the article is intentionally withdrawn from the holding member 50 by the user.

Continuing to refer to FIG. 3, in still other embodiments, the lid 30 may be biased toward the closed position, such that the user must apply a force to the lid (e.g., manually or automatically, such as when the lid is opened using automated controls of the storage unit) that overcomes the biasing force. The biasing force may be provided by a spring component 60 proximate the hinge 32 and/or cooperating with the hinge 32. In this way, when the force applied to the lid 30 to hold the lid in the open position is removed (e.g., manually or automatically), the lid 30 may return to the closed position without requiring further intervention from the user. This feature may be useful, for example, in embodiments, in which the compartments are oriented as depicted in FIG. 2, so that the compartment being accessed is closed as soon as access is no longer required to provide the user with access to other proximate compartments that may be needed (e.g., when only one compartment at a time can be accessed) and/or to allow the respective drawer to be closed (e.g., where the open lid may interfere with closure of the drawer).

In other embodiments, however, the lid 30 may be configured to provide dual-direction biasing. For example, the lid 30 may be biased toward the closed position when the lid is rotated approximately 90° or less from the closed position, but may be biased toward the open position when rotated more than 90° from the closed position. In this way, the biasing force may ensure that the compartment 20 is completely closed if the lid 30 is left within a range of rotation angles between approximately 0° and approximately 90° (e.g., indicating that the user intends to close the lid), while at the same time facilitating opening of the compartment when the lid is within a range of rotation angles between approximately 90° and approximately 180° or more (e.g., indicating that the user intends to open the compartment). The biasing force of the lid 30 may thus assist the user in both keeping the compartment 20 fully open and securely closed.

Other features and functionalities may be provided on the compartment according to the preferences of the user to facilitate and enhance the user's access to the compartments and the articles stored therein. For example, in some embodiments, the compartment 20 may comprise a sensor 70 disposed on at least one of the lid 30, the receptacle 40, or the holding member 50. In FIG. 3, for example, the sensor 70 is disposed on the lid 30. The sensor 70 may be configured to detect the presence of the article 25 that is secured to the lid 30 via the holding member 50 and/or may be configured to detect removal of the article. When the storage unit 5 is an automated dispensing cabinet, for example, data from the sensor 70 may be provided to the user via a display of the cabinet to let the user know which compartments are empty and which compartments have articles 25 stored therein. In this way, the user may know which compartment 20 to open to gain access to certain articles 25 without having to open the compartment first. In other embodiments, such as in non-automated dispensing cabinets, the lid 30 may be configured to be transparent or at least partially transparent, so as to allow the user to see through the lid to visually identify which compartments are occupied and which are vacant. In this regard, the holding member 50 itself may be transparent or at least partially transparent, so as not to obscure a view of the article 25.

In some cases, compartments 20 may be configured to store multiple articles. With conventional compartments, a user may be required to count the articles stored in a particular compartment to provide or update an inventory of the compartment or storage unit and/or to verify that the correct articles were dispensed. Relying on a user's manual count in such cases, however, places a burden on the user and creates a risk of inaccurate inventory as the exact article that was dispensed cannot be accurately identified or tracked.

Figure 7:
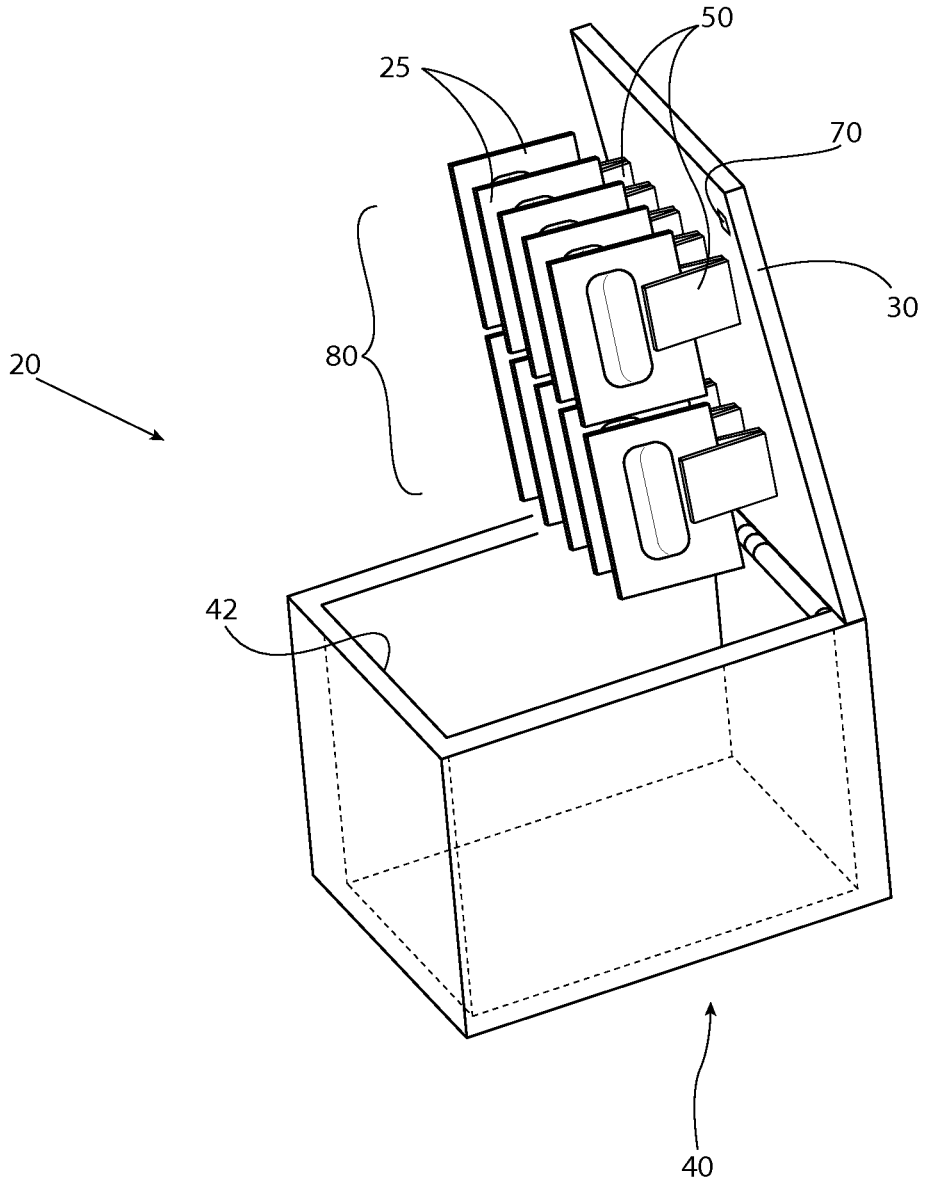
FIG. 7 illustrates a compartment having an array of holding members disposed on the lid according to an example embodiment of the present invention.

Accordingly, in some embodiments, the sensor 70 may enable the storage unit to automatically record the removal of an article 25 from the respective compartment 20. For example, although the embodiments depicted in FIGS. 1-4 show a compartment 20 having only one holding member 50 disposed on the lid 30, in certain embodiments the holding member may comprise an array 80 of holding members, such as (for example) a 5×2 array of holding members arranged as shown in FIG. 7. The array 80 of holding members 50 may be, for example, configured to secure multiple unit dose packages (FIG. 5A) or unit dose blister packages (FIG. 5B) to the lid 30. In this regard, a sensor (such as the sensor 70 shown in FIG. 3) may be configured to detect and/or record the removal of each article 25 from the array 80 and may further be configured to update an inventory of the storage unit with the data obtained. In this way, the risk of inaccurate inventories and user delay in having to conduct manual counts may be minimized or eliminated. Moreover, even in embodiments in which a sensor 70 is not provided, presentation of multiple articles 25 using an array 80 of holding member 50 as described above may facilitate manual counts of the articles, as users may be able to view and count the articles without touching or removing the articles from the compartments.

As noted above, providing an array 80 of holding members 50 (regardless of the sensor 70) may also allow for the space in the respective compartment 20 to be more efficiently used, while at the same time the user need not fumble around in the receptacle in an attempt to grasp and withdraw one of the packages from among a number of packages being stored within the compartment. In this way, all of the packages stored in the compartment 20 would be removed from the receptacle 40 and presented to the user at the same time, and the user would be able to select one or more of the articles 25 to dispense more easily. As a result, embodiments of the invention may allow compartments to be made smaller to accommodate only the size and quantity of the articles that are intended to be stored, rather than requiring the size of the compartment to be sized large enough to also accommodate the size of the user's hand for manually removing the article from the receptacle.

Furthermore, in some embodiments, such as in embodiments in which the storage unit is an automated dispensing cabinet, for example, access to the drawers 10, 12 may be restricted to certain authorized users. In this regard, one or more of the drawers 10, 12 (or in some cases, the compartments 20) may be accessible only when medication stored in the particular drawer (or a particular compartment) is to be dispensed. Accordingly, each drawer 10, 12 and/or compartment 20 may be in a locked state until an authorized user interfaces with the storage unit 5 to dispense a particular medication stored within a particular compartment, at which point the storage unit may unlock and/or open the drawer and/or compartment containing the selected medication to allow the user's access. In some cases, the storage unit 5 may unlock all of its drawers 10 upon determining that a user is authorized to access the storage unit, regardless of the location of the particular medication requested, wherein in other cases, the storage unit may unlock only a particular compartment 20 or set of compartments upon the request by the user to access a particular prescription.

The storage units and compartments configured according to embodiments of the invention as described above may thus allow a user to identify and dispense articles of various shapes and sizes, and in particular small, loose articles that may have a tendency to "get lost" in a compartment of a storage unit, in an easier and more efficient manner. A method of dispensing medication from a storage unit configured according to the embodiments described above is thus provided, in which an article is stored within a compartment of the storage unit. As described above, the storage unit may include a receptacle configured to receive the article and defining an opening via which the article is received, as well as a lid and at least one holding member disposed on the lid. As described above, the lid may be configured to move into and out of engagement with the opening of the receptacle so as to define an open position in which the lid is out of engagement with the opening of the receptacle and a closed position in which the lid is in engagement with the opening of the receptacle. The article may be releasably secured to the lid via the holding member.

Accordingly, the article may be presented to the user for dispensing from the compartment upon movement of the lid to the open position. As described above, presenting the article to the user in this way may comprise at least partially removing the article from the receptacle. To dispense the article from the compartment, the user need only grasp a portion of the article and pull the article from the holding member. Moreover, as described above, in the closed position, the holding member and the article may be received within the receptacle.

In some embodiments, storing the article within the compartment may include receiving the article between a first arm and a second arm of the holding member. In some cases, presenting the article to the user may comprise supporting a side of the article. In addition or alternatively, in some embodiments, removal of the article secured to the lid via the holding member may be detected, such as via a sensor disposed on the lid, receptacle, or holding member, as described above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. For example, although the description above makes reference to storage units and articles in the context of a health care provider, such as carts and cabinets storing medications in a pharmacy or hospital environment, it is understood that the embodiments described may be applicable to any type of articles in any field. Although specific terms are employed herein, they are used in a generic and descriptive sense only and not for purposes of limitation.

What is claimed is:

1. A medication storage unit for dispensing medication comprising a plurality of compartments, at least one of the compartments comprising:

a receptacle configured to receive a medical article and defining an opening via which the medical article is received;

a lid configured to move into and out of engagement with the opening of the receptacle so as to define an open position in which the lid is out of engagement with the opening of the receptacle and a closed position in which the lid is in engagement with the opening of the receptacle, wherein the lid is hingedly connected to a rear sidewall of the respective compartment such that, in the open position, the lid is configured to rest on a closed lid of an adjacent compartment; and a holding member disposed on the lid, wherein the holding member comprises a first arm and a second arm, and wherein each of the first and second arms extends outwardly and away from an inner surface of the lid to form a C-shape, wherein the first and second arms are biased toward each other and are configured to receive at least a portion of the medical article therebetween to releasably secure the medical article to the lid, wherein, in the closed position, the holding member and a medical article secured to the lid via the holding member are received within the receptacle, and wherein, in the open position, the medical article secured to the lid via the holding member is at least partially removed from the receptacle so as to be presented to a user for dispensing from a respective compartment.

2. The medication storage unit of claim 1, wherein at least some of the compartments are oriented with respect to the storage unit such that the respective lid and holding member support a side of the medical article in the open position.

3. The medication storage unit of claim 1, wherein the medical article comprises at least one article selected from the group consisting of a vial, an ampoule, a single dose syringe, or a tube.

4. The medication storage unit of claim 1, wherein the at least one compartment is arranged within a drawer of the medication storage unit, and wherein the drawer is configured to be slidingly received within the medication storage unit.

5. The medication storage unit of claim 1, wherein the holding member is integral to the lid.

6. The medication storage unit of claim 1, wherein the lid is connected to the receptacle via a hinge.

7. The medication storage unit of claim 1, wherein the lid is biased toward the closed position.

8. The medication storage unit of claim 1, wherein the lid is configured to provide dual-direction biasing.

* * * * *